United States Patent [19]

Hehn

[11] Patent Number: 4,779,356

[45] Date of Patent: Oct. 25, 1988

[54] DRYER FOR PHOTOSENSITIVE MATERIAL

[75] Inventor: Wilfried Hehn, Munich, Fed. Rep. of Germany

[73] Assignee: AGFA-Gevaert Aktiengesellschaft, Leverkusen, Fed. Rep. of Germany

[21] Appl. No.: 27,342

[22] Filed: Mar. 18, 1987

[30] Foreign Application Priority Data

Apr. 3, 1986 [DE] Fed. Rep. of Germany ..... 3611074

[51] Int. Cl.[4] ..... F26B 15/10

[52] U.S. Cl. ..... 34/114; 34/120; 34/151; 34/203

[58] Field of Search ..... 34/122, 148, 151, 203, 34/155, 159, 114, 120

[56] References Cited

U.S. PATENT DOCUMENTS

| | | | |
|---|---|---|---|
| 1,743,921 | 1/1930 | Kerley | 34/151 |
| 2,058,983 | 10/1936 | Horn | 34/151 |
| 3,205,591 | 9/1965 | Edwards | 34/151 |
| 3,229,608 | 1/1966 | Staub et al. | 34/151 |
| 3,524,397 | 8/1970 | Hruby | 34/151 |
| 3,545,364 | 12/1970 | Reedy | 34/155 |
| 3,557,469 | 1/1971 | Edgington | 34/151 |
| 3,726,023 | 4/1973 | Geyken | 34/151 |
| 3,895,450 | 7/1975 | Hope et al. | 34/155 |
| 3,900,959 | 8/1975 | Breschi et al. | 34/41 |
| 4,212,379 | 7/1980 | Hope et al. | 34/159 |
| 4,693,016 | 9/1987 | Yamazaki et al. | 34/122 |

FOREIGN PATENT DOCUMENTS 2615905 10/1977 Fed. Rep. of Germany .

*Primary Examiner*—Larry I. Schwartz
*Attorney, Agent, or Firm*—Peter K. Kontler

[57] ABSTRACT

A dryer for photosensitive material has a main housing. A blower housing with a blower is mounted inside the main housing. A container defining a drying compartment is also mounted inside the main housing on top of the blower housing. An inlet opening in the bottom of the container establishes communication between the blower and the drying compartment. A transporting unit consisting of a support which carries a series of transporting rollers, a series of guides and drive means for at least some of the rollers is removably mounted in the container. The main housing is provided with an aperture, and the transporting unit functions to draw photosensitive material into and to discharge photosensitive material from the drying compartment via the aperture. The main housing is further provided with an air admitting opening for the admission of fresh air to the blower. The blower housing and the container cooperate with the main housing to define air flow channels so that drying air which has traveled through the drying compartment can be recirculated to the blower. The container has an open upper end, and the main housing has a removable cover which overlies such end. This allows the transporting unit to be withdrawn from the container in the event of a malfunction, or for maintenance or repair. The transporting unit can subsequently be reinserted in the container.

33 Claims, 1 Drawing Sheet

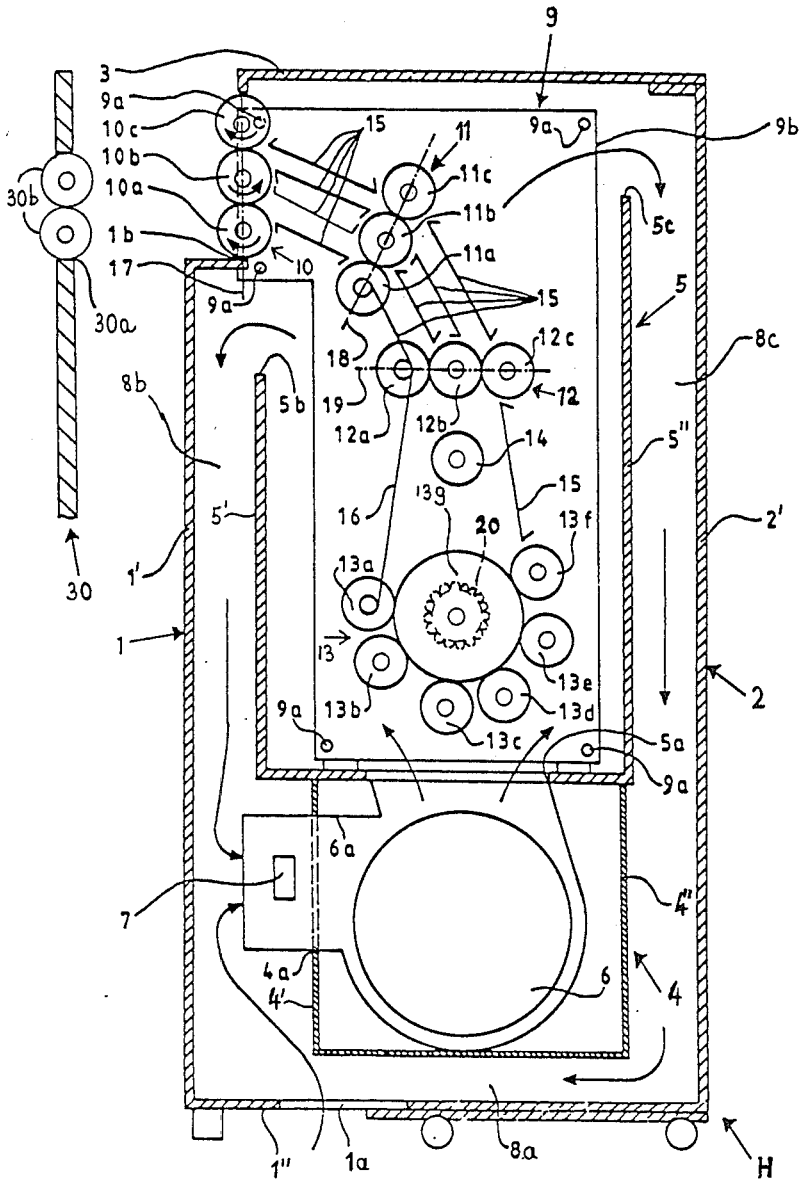
9
3
9a
10c
10b
10a
1b
17
30b
30a
30
15
11
11c
11b
11a
9a
9b
5c
10
9a
5
8c
18
12c
12
19
12a
12b
14
5b
8b
5"
5'
1'
16
13g
15
20
13f
2'
13a
13
1
13e
13b
13d
13c
2
9a
5a
9a
6a
7
4"
4a
4'
6
4
1"
1a
8a
H

DRYER FOR PHOTOSENSITIVE MATERIAL

BACKGROUND OF THE INVENTION

The invention relates generally to a dryer for photosensitive material, e.g., photographic paper.

More particularly, the invention relates to a dryer which is designed to be connected with a developing machine for photosensitive material.

A known dryer designed to be connected with a developing machine for photosensitive material is provided with an aperture for passage of the photosensitive material. The dryer includes transporting elements for the photosensitive material, and these elements are arranged in such a manner that photosensitive material to be dried enters the dryer with the emulsion side facing down and leaves the dryer via the aperture with the emulsion side facing up.

Such a dryer is disclosed in the West German Auslegeschrift No. 26 15 905. The transporting means here includes many discs which are disposed opposite but are offset relative to one another. This arrangement is expensive as well as bulky and, in the event of a disturbance, is complicated to manipulate. In addition, the arrangement causes streaks to develop on the photosensitive material during drying.

OBJECTS AND SUMMARY OF THE INVENTION

It is an object of the invention to provide a dryer which may be constructed relatively compactly.

Another object of the invention is to provide a dryer which does not require an excessive number of discrete components.

An additional object of the invention is to provide a dryer which may be designed for relatively easy maintenance and cleaning.

A further object of the invention is to provide a dryer of the type outlined above which can define a relatively long drying path with relatively little room and relatvvely few discrete components, and may be designed for relatively easy cleaning and maintenance.

It is also an object of the invention to provide an improved drying method for photosensitive material.

Still another object of the invention is to provide a dryer which can serve as an improved substitute for known dryers.

The preceding objects, as well as others which will become apparent as the description proceeds, are achieved by the invention.

The invention provides an arrangement for processing photosensitive material, e.g., photographic paper. The arrangement includes a dryer, and such dryer comprises a housing having at least one aperture for the passage of photosensitive material. The dryer further comprises drying means for drying photosensitive material in the housing, and a transporting device for advancing photosensitive material through the housing. The transporting device includes a support, transporting rollers mounted on the support, and drive means for at least some of the rollers mounted on the support. The transporting device is insertable in and removable from the housing as a unit.

The arrangement may further include a developing machine for photosensitive material, and the dryer may be designed for connection with this machine. The dryer may also be designed to accept photosensitive material to be dried with the emulsion side facing down and to discharge the photosensitive material through the aperture of the housing with the emulsion side facing up.

A container defining a drying compartment and designed to receive the transporting means may be disposed in the housing. The container may have an upper open end for insertion of the transporting device therein and removal of the latter therefrom, and the housing may include a removable cover overlying the upper open end of the container.

The drying means may comprise a blower which is located inside the housing and serves to create an air current in the latter. The container then has an air inlet opening for the admission of air into the container.

The axes of rotation of the transporting rollers are preferably parallel to one another. The housing may include a pair of opposed generally parallel walls which extend in substantial parallelism with the axes of rotation of the transporting rollers when the transporting device is received by the container. The container advantageously defines an air flow channel with each of these walls.

The disposition of the transporting rollers and the drive means for at least some of these rollers so as to be insertable in and removable from the dryer as a unit yields a particularly favorable grouping of transporting components both as regards the mounting of the components and the number of individual components. Moreover, this allows the transporting rollers and the drive means to be readily removed from the dryer in the event of a disturbance, e.g., a paper back-up.

The provision of a container which is surrounded by the housing of the dryer and is designed to accommodate the transporting device or unit makes it possible to create space for a blower and associated air heater, as well as for suction and air circulation channels, in a simple manner. Thus, space for the blower, heater and channels may be defined between the container and the housing.

The transporting rollers advantageously include one or more groups each of which contains three rollers and functions both to advance photosensitive material into the housing and/or container and to discharge photosensitive material from the housing and/or container. The transporting rollers preferably further include an additional roller which is located below the group or groups and serves to change the direction of advance of the photosensitive material so as to direct the latter back to the group or groups. This arrangement of rollers makes it possible to reduce the number of transporting rollers.

The novel features which are considered as characteristic of the invention are set forth in particular in the appended claims. The improved dryer itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a transverse sectional view of a dryer according to the invention.

DESCRIPTION OF THE PREFERRED EMBODIMENTS

Referring to the FIGURE, the reference character H generally identifies a housing of a dryer in accordance with the invention. The housing H is divided into three parts 1, 2 and 3. The housing part 1, which constitutes the front part of the housing H, comprises a generally upright side wall 1' and a generally horizontal bottom wall 1''. The bottom wall 1'' is provided with an air admitting opening 1*a*. However, the air admitting opening 1*a* could just as well be formed in the lower part of the side wall 1'.

The housing part 1 sits on legs or rims constituting part of the same. The housing part 1 extends upwards to, or to the region of, the upper side of the housing H.

The housing part 2 includes a generally upright side wall 2' which is disposed opposite and parallels the side wall 1'. The width of the housing part 2 is less than that of the housing H so that the housing part 2 extends across only a portion of the depth of the housing H. The housing part 2 is shiftable relative to the housing part 1 in a sense to change the distance between the side walls 1', 2'. This permits the size of the air admitting opening 1*a* to be varied.

The housing H is completed at the top by the housing part 3 which is in the form of a removable cover. An aperture 1*b* is defined at the front side of the housing H by the housing parts 1,3. The aperture 1*b* serves for the introduction of photosensitive material, e.g., photographic paper, to be dried into the housing H and for the discharge of photosensitive material therefrom.

The dryer including the housing H is connected or connectible to a developing machine 30 for photosensitive material. The developing machine 30 is illustrated only fragmentarily since it is entirely conventional and does not constitute part of the invention per se. The developing machine 30 has a discharge aperture 30*a* which may be directly joined to the aperture 1*b* of the housing H. The developing machine 30 further has a pair of discharge rollers 30*b* which function to withdraw wet photosensitive material from the developing machine 30 and to advance such material into the dryer including the housing H.

Inside the dryer housing H is a blower housing 4 which accommodates a blower 6. The blower 6 is designed to generate an air current which travels in a direction transverse to the rotational axis of its blades. The blower housing 4 has a generally upright side wall 4' which confronts and is parallel to the side wall 1' of the housing part 1, and such wall 4' is provided with a suction opening 4*a* paralleling the aperture 1*b*. The blower 6 includes a suction nozzle 6*a* which projects through the suction opening 4*a*. A heater 7 for heating air which is drawn into the blower 6 may be disposed upstream of or in the suction nozzle 6*a*. The air admitting opening of the dryer housing H is located in the region of the suction nozzle 6*a*.

The blower housing 4 has a second generally upright side wall 4'' which confronts and is parallel to the side wall 2' of the housing part 2. The walls 4', 4'' are spaced from the respective side walls 1',2' of the dryer housing H. The blower housing 4 further has a bottom wall which is spaced from and parallel to the bottom wall 1'' of the housing part 1. The bottom wall of the blower housing wall 4 cooperates with the bottom wall 1'' of the dryer housing H to define an air flow channel 8*a*.

A container or tank 5 is mounted on top of and secured to the blower housing 4. The container 5 defines a drying compartment for photosensitive material and has a bottom wall which overlies the blower housing 4. The bottom wall of the container 5, which is parallel to the bottom wall 1'' of the dryer housing H, is provided with an air inlet opening 5*a* through which the blower 6 forces air into the container 5. Such air, which may be heated by the heater 7, serves to dry photosensitive material travelling through the container 5.

The container 5 further has a pair of opposed generally upright side walls 5' and 5''. The side wall 5' confronts and is parallel to the side wall 1' of the housing H while the side wall 5'' confronts and is parallel to the side wall 2' of the housing H. The upper end of the container 5 is open, and the cover 3 of the housing H overlies the open upper end of the container 5.

The side walls 5',5'' of the container 5 are spaced from the respective side walls 1',2' of the housing H. The side wall 5' of the container 5 and the side wall 4' of the blower housing 4 cooperate with the side wall 1' of the housing H to define an air flow channel 8*b*. Similarly, the side wall 5'' of the container 5 and the side wall 4'' of the blower housing 4 cooperate with the side wall 2' of the housing H to define an air flow channel 8*c*.

The upper edge 5*b* of the side wall 5' is located a certain distance below the aperture 1*b* whereas the upper edge 5*c* of the side wall 5'' is located a certain distance below the cover 3. Accordingly, a gap exists above the upper edge 5*b* and above the upper edge 5*c*. These gaps establish communication between the interior of the container 5 and the air flow channels 8*b*,8*c*. Since the container 5 is open at the top, drying air which has passed through the container 5 can be recirculated to the blower 6 via the air flow channels 8*a*,8*b*,8*c* as indicated by arrows. As also indicated by an arrow, the air flow channels 8*a*,8*b* further serve to conduct fresh air drawn in through the air admitting opening 1*a* to the blower 6.

A rack or transporting device 9 is removably received by the container 5. Therack 9 includes a support made up of two opposed, upright, generally parallel plates 9*b* which are connected to, and held at a distance from one another by distincing elements 9*a*, e.g., bolts. Only the rear plate 9*b* is visible in the drawing. The rack 9 further includes several groups 10, 11, 12, 13 of transporting rollers which are mounted on the plates 9*b*. The rack 9 also includes one or more guide rollers 14 and/or one or more guide elements 15 of sheet material and/or one or more guide elements 16 in the form of wire. In the illustrated embodiment, several of the sheet-like guide elements 15 are disposed between the roller groups 10, 11 so as to define guide passages for photosensitive material, and several of the sheer-like guide elements 15 are likewise disposed between theroller groups 11, 12 so as to form guide passages for photosensitive material. Moreover, one or more of the guide rollers 14, one or more of the sheet-like guide elements 15 and one or more of the wire-like guide elements 16 are located between the roller groups 12, 13. The guide roller or rollers 14 cooperate with the sheet-like guide element or elements 15 and with the wire-like guide element or elements 16 to define additional guide passages for photosensitive material. Similarly to the roller groups 10–13, the guide elements 14–16 are mounted on the plates 9*b* of the rack 9.

At least some rollers of the roller groups 10–13 are driven, and the rack 9 additionally includes drive means for such rollers. The drive means for each driven roller may, for instance, comprise a gear or set of gears as shown at 20 for one of the rollers 13g of the roller group 13. The drive means for the driven rollers of the roller groups 10–13 are mounted on the outside of one of the plates 9b in a manner known per se.

All rollers of the rack 9 are arranged such that the respective axes of rotation thereof extend in substantial parallelism with one another. When the rack 9 is disposed in the container 5, the axes of rotation of the rollers are parallel to the side walls 1', 2', 4', 4'', 5', 5'' and to the axis of rotation of the blades of the blower 6.

The height of the rack 9 is selected in such a manner that it projects above the upper edges 5b,5c of the container 5 when the rack 9 is accommodated by the container 5.

In order to insert the rack 9 in the container 5, the cover 3 of the housing H is removed and the rack 9 is lowered into the container 5. Once the rack 9 is properly positioned in the container 5, the cover 3 may be replaced. The rack 9 is readily removable from the container 5 in the event of a malfunction as well as for cleaning and repair.

The roller group 10 consists of three rollers 10a,10b,10c which are arranged on a line so that the axes of rotation thereof lie in a common plane 17. The plane 17 is vertically oriented and parallel to the side walls 1', 2', 4', 4'', 5', 5'' when the rack 9 is received by the container 5. The roller group 10 functions to draw photosensitive material into and to discharge photosensitive material from the housing H. To this end, the middle roller 10b and the lower roller 10a of the group 10 rotate in a sense to draw photosensitive material into the housing H. On the other hand, the middle roller 10b and the upper roller 10c of the group 10 rotate in a sense to discharge photosensitive material from the housing H. Photosensitive material to be dried is delivered from the developing machine 30 to the nip of the rollers 10a,10b with the emulsion side facing down. The dried photosensitive material is subsequently discharged from the housing H via the nip of the rollers 10b,10c with the emulsion side facing up.

The plates 9b of the rack 9 are designed in such a manner that the roller group 10 is located in the aperture 1b of the housing H when the rack 9 rests in the container 5. The roller group 10 is dimensioned such that it substantially fills the aperture 1b.

The rollers 10a,10b,10c are advantageously composed of rubber having a Shore hardness between 30 and 100.

The roller group 11, which follows the roller group 10 as considered in a direction from the top to the bottom of the rack 9, again consists of three rollers 11a,11b,11c which are arranged on a line so that their axes of rotation line in a common plane 18. The plane 18 is inclined with respect to the side walls 1', 2', 4', 4'', 5', 5'' when the rack 9 is accommodated in the container 5. The roller group 11 functions to advance photosensitive material from the group 10 towards the container 5 as well as from the latter back to the group 10. Thus, the middle roller 11b and lower roller 11a of the group 11 rotate in a sense to convey photosensitive material towards the container 5 while the middle roller 11b and upper roller 11c rotate in a sense to convey photosensitive material away from the container 5.

The roller group 12 follows the roller group 11 as considered in a direction from the top to the bottom of the rack 9. The roller group 12 also consists of three rollers 12a,12b,12c which are arranged on a line so that the axes of rotation thereof are disposed in a common plane 19. The plane 19 is essentially horizontal and perpendicular to the side walls 1', 2', 4', 4'', 5', 5'' when the rack 9 is situated in the container 5. The roller group 12 functions to introduce photosensitive material into and to withdraw photosensitive material from the container 5. Accordingly, the middle roller 12b and left-hand roller 12a of the group 12 rotate in a sense to feed photosensitive material into the container 5. On the other hand, the middle roller 12b and right-hand roller 12c of the group 12 rotate in a sense to withdraw photosensitive material from the container 5.

The roller group 13 follows the roller group 12 as considered in a direction from the top to the bottom of the rack 9. The roller group 13 is made up of a relatively large central roller 13g and a series of smaller rollers 13a,13b,13c,13d,13e,13f which are distributed about the periphery of the central roller 13g. Photosensitive material issuing from the nip between the rollers 12a,12b enters the nip between the rollers 13a,13g and thereafter successively travels through the nips defined by the central roller 13g and the respective peripheral rollers 13b,13c,13d,13e,13f. The rollers 13a–13g are arranged such that the direction of travel of the photosensitive material is changed by at least 180° as the photosensitive material passes through the roller group 13. The roller group 13 functions to direct photosensitive material issuing from the nip between the rollers 12a,12b to the nip between the rollers 12b,12c.

Photosensitive material entering the housing H successively passes between the rollers 10a,10b; the rollers 11a,11b; and the rollers 12a,12b. The direction of travel of the photosensitive material is then reversed by the roller group 13, and the photosensitive material thereafter successively passes between the rollers 12b,12c; the rollers 11b,11c; and the rollers 10b,10c.

As already mentioned, the emulsion side of the photosensitive material faces down when the latter is drawn into the housing H by the rollers 10a,10b. Since the roller group 13 reverses the direction of travel of the photosensitive material, the emulsion side faces up upon discharge of the photosensitive material from the housing H by the rollers 10b,10c. This makes it possible to observe the emulsion side of the photosensitive material as it leaves the housing H so that an immediate determination can be made as to whether the photosensitive material has been processed properly.

In the illustrated embodiment, the photosensitive material travels horizontally as it enters and leaves the housing H. However, the arrangement could just as well be such that the photosensitive material is inclined to the horizontal upon entering and leaving the housing H.

The roller groups 10,11,12 may be considered to be constituted by admitting and discharge rollers whereas the roller group 13 may be considered to be constituted by deflecting rollers. The plane 17 of the admitting-discharge roller group 10 and the plane 18 of the neighboring admitting-discharge roller group 11 define an acute angle with one another. Similarly, the planes 18,19 of the neighboring admitting-discharge roller groups 11,12 make an acute angle with each other. Advantageously, the plane 17 of the admitting-discharge roller group 10 nearest the aperture 1b and the plane 19 of the admitting-discharge roller group 12 nearest the deflecting roller group 13 define an angle of 90° with one another. The photosensitive material is then deflected through an angle of 90° while travelling from the roller group 10 to the roller group 12 and, after reversing its direction of travel in the roller group 13, is thereafter deflected through an angle of 90° in the opposite sense while travelling from the roller group 12 to the roller group 10. When the plane 17 of the roller group 10 is vertical and the plane 19 of the roller group 12 is horizontal, the photosensitive material is deflected from a horizontal to a vertical orientation during travel from the roller group 10 to the roller group 12, and from a vertical back to a horizontal orientation during travel from the roller group 12 to the roller group 10.

One or more additional admitting-discharge roller groups similar to the roller groups 10–12 may be mounted on the rack 9 if necessary or desirable.

It has been found to be of advantage, particularly when photographic paper is to be dried, for the middle rollers 11*b*,12*b* and the discharge rollers 11*c*,12*c* of the roller groups 11,12; for the peripheral rollers 13*a*–13*f* of the roller group 13; and for the guide roller or rollers 14 to consist of a foamed material. An example of such a material is a polyether foam having a density of 20 to 80 kg/m$^3$. The admitting rollers 11*a*,12*a* of the roller groups 11,12 are favorably composed of a polyvinylchloride foam, a polypropylene foam or a polyethylene foam whereas the central roller 13*g* of the roller group is advantageously composed of a polyethylene.

In operation, the heater 7 is switched on and the blower 6 is started. Wet photosensitive material from the developing machine 30 is drawn into the housing H and through the drying compartment in the container 5 by means of the roller groups 10–13. The blower 6 blows warm air upwards into and through the drying compartment via the air inlet opening 5*a* in the bottom of the container 5. Advantageously, the blower 6 is designed to blow air over the entire length of the rollers, that is, over the entire distance between the plates 9*b* of the rack 9. The warm drying air flows upwards through the container 5 along the emulsion side of the photosensitive material thereby drying the emulsion side. In the process, the drying air is cooled. The cooled drying air leaves the container 5 via the upper open end thereof and flows over the upper edges 5*b*,5*c* of the side walls 5′,5″ into the air flow channels 8*b*,8*c*. Due to its cooling and to the suction created by the blower 6, the air leaving the container 5 flows downwards along the air flow channels 8*b*,8*c* and back to the suction nozzle 6*a* of the blower 6. The recirculated air from the container 5 is combined with fresh air drawn in through the air admitting opening 1*a* of the housing H and readmitted into the container 5 by the blower 6.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An arrangement for processing photosensitive material, said arrangement including a dryer, and said dryer comprising a housing having an aperture for the passage of photosensitive material; drying means for drying photosensitive material in said housing; and a transporting device for advancing photosensitive material through said housing, said device including a support, transporting rollers mounted on said support, guide means provided on said support and cooperating with said rollers to repeatedly change the direction of travel of photosensitive material in said housing and to define with said rollers an elongated path having a plurality of mutually inclined portions and provided with an inlet and an outlet in said aperture, and drive means for at least some of said rollers mounted on said support, said device being insertable in and removable from said housing as a unit.

2. The arrangement of claim 1, comprising a container in said housing defining a drying compartment and designed to accommodate said device.

3. The arrangement of claim 2, wherein said container has an open upper end for insertion of said device in and removal of said device from said container.

4. The arrangement of claim 3, wherein said housing comprises a removable cover overlying said upper end.

5. The arrangement of claim 3, wherein said drying means comprises blowing means for creating an air current in said container, said container having an inlet opening for the admission of air therein.

6. The arrangement of claim 5, wherein said container defines at least one air flow channel with said housing.

7. The arrangement of claim 6, said housing including a pair of oppositely disposed generally parallel side walls, and said rollers having respective axes of rotation which are substantially parallel to said walls when said device is in said container; and wherein said container defines an air flow channel with each of said walls.

8. The arrangement of claim 1, wherein said drying means is located in said housing.

9. The arrangement of claim 1, further comprising a developing machine arranged to discharge photosensitive material into said housing.

10. The arrangement of claim 1, said rollers including a group of three rollers having respective axes of rotation which lie in a common plane; and wherein said group is arranged to draw photosensitive material into and to discharge photosensitive material from said housing when said device is accommodated therein.

11. The arrangement of claim 10, wherein the rollers of said group are disposed in said aperture.

12. The arrangement of claim 11, said housing having a removable cover and at least one side wall; and wherein said aperture is defined by said wall and said cover.

13. The arrangement of claim 12, wherein said plane substantially parallels said wall when said device is disposed in said housing.

14. The arrangement of claim 1, comprising a container in said housing defining a drying compartment and designed to accommodate said device, said container having an upper open end for insertion of said device in and removal of said device from said container, and said housing including a removable cover overlying said upper end; and wherein said drying means comprises blowing means for creating an air current in said container, said container having an inlet opening for the admission of air therein and defining at least one air flow channel with said housing.

15. The arrangement of claim 14, said rollers having respective substantially parallel axes of rotation; and wherein said container comprises a pair of oppositely disposed first side walls which are generally parallel to said axes when said device is in said container, said housing including a pair of oppositely disposed second side walls which are essentially parallel to said first side walls, each of said first walls defining an air flow channel with and terminating below a respective second wall.

16. The arrangement of claim 15, wherein said device projects above said first walls when said device is in said container.

17. The arrangement of claim 14, wherein said inlet opening is provided in the bottom of said container.

18. The arrangement of claim 17, wherein said blowing means is disposed below said container.

19. The arrangement of claim 18, wherein said housing is provided with an air admitting opening of adjustable size in the region of the lower end thereof.

20. The arrangement of claim 19, said blowing means having a suction nozzle opening into said channel; and wherein said air admitting opening is located in the region of said nozzle.

21. The arrangement of claim 1, comprising a container in said housing defining a drying compartment and designed to accommodate said device; and wherein said rollers include a first group of three rollers having respective axes of rotation which lie in a common first plane, and a second group of three rollers having respective axes of rotation which lie in a common second plane, said planes defining an acute angle with one another.

22. The arrangement of claim 21, wherein said first group is arranged to draw photosensitive material into and to discharge photosensitive material from said housing when said device is accommodated in said container, said second group being arranged to advance photosensitive material into and to withdraw photosensitive material from said container.

23. The arrangement of claim 21, wherein said rollers further include a third group of three rollers having respective axes of rotation which lie in a common third plane, said second group being disposed between said first and third groups, and said third plane being substantially horizontal when said device is in said container.

24. The arrangement of claim 23, wherein said first plane is substantially vertical when said device is in said container.

25. The arrangement of claim 23, wherein said second and third planes define an acute angle with one another.

26. The arrangement of claim 21, wherein said rollers further include an additional group of rollers, said second group being disposed between said first group and said additional group, and said additional group including a central roller, and a plurality of additional rollers distributed about the periphery of said central roller.

27. The arrangement of claim 26 wherein said guide means comprises a plurality of guide elements, at least one of said guide elements being disposed between each pair of groups.

28. The arrangement of claim 1, wherein said guide means comprises a sheet-like guide element and/or a wire-like guide element and/or a guide roller.

29. The arrangement of claim 26, wherein said first group is arranged to draw photosensitive material into and to discharge photosensitive material from said housing when said device is in said container, each of the rollers of said first group having an outer surface consisting essentially of rubber with a Shore hardness of about 30 to about 100.

30. The arrangement of claim 26, wherein the middle roller and another roller of said second group cooperate to withdraw photosensitive material from said container when said device is disposed therein, said middle roller, said other roller and said additional rollers each having an outer surface consisting essentially of a polyether foam wth a density of about 20 to about 80 kg/m$^3$.

31. The arrangement of claim 30, wherein said central roller has an outer surface consisting essentially of a polyethylene.

32. The arrangement of claim 1, wherein said quide means comprises a guide roller for the photosensitive material, said guide roller having an outer surface consisting essentially of a polyether foam with a density of about 20 to about 80 kg/m$^3$.

33. The arrangement of claim 26, wherein the middle roller and another roller of said second group cooperate to advance photosensitive material into said container when said device is disposed therein, said other roller having an outer surface consisting essentially of a polyvinylchloride foam, a polypropylene foam or a polyethylene foam.

* * * * *